US005353379A

United States Patent [19]

Nakajima et al.

[11] Patent Number: 5,353,379

[45] Date of Patent: Oct. 4, 1994

[54] INFORMATION REPRODUCING APPARATUS AND GAME MACHINE INCLUDING THE SAME

[75] Inventors: Tooru Nakajima; Takeo Tobe, both of Tokorozawa, Japan

[73] Assignee: Pioneer Electronic Corporation, Tokyo, Japan

[21] Appl. No.: 118,688

[22] Filed: Sep. 10, 1993

Related U.S. Application Data

[63] Continuation of Ser. No. 920,521, Jul. 28, 1992, which is a continuation of Ser. No. 492,502, Mar. 13, 1990.

[30] Foreign Application Priority Data

Mar. 31, 1989 [JP] Japan ..... 1-82679

[51] Int. Cl.[5] ..... G10L 3/00

[52] U.S. Cl. ..... 395/2.83; 395/2.74

[58] Field of Search ..... 381/51-53; 84/675, 697; 395/2.67, 2.83, 2.86, 2.79; 369/32, 33, 34; 360/22; 365/244

[56] References Cited

U.S. PATENT DOCUMENTS

| | | | |
|---|---|---|---|
| 3,146,309 | 8/1964 | Clapper | 381/53 |
| 4,051,331 | 9/1977 | Strong | 381/50 |
| 4,500,971 | 2/1985 | Futaki et al. | 395/2 |
| 4,791,496 | 12/1988 | Kageyama | 358/342 |
| 4,959,735 | 9/1990 | Kawai | 358/342 |

*Primary Examiner*—David D. Knepper

*Attorney, Agent, or Firm*—Sughrue, Mion, Zinn, Macpeak & Seas

[57] ABSTRACT

In an information reproducing apparatus, a sound generator generates an indication audio signal corresponding to an external operation state and a performance state to produce it externally without conversion or with conversion into sound. As a result, a wide variety of sounds or voice sounds acting as a warning sound against an erroneous operation and a caution sound telling performance termination are produced and hence an information of warning or caution concerning the operation can be supplied to an user and further can be used as an effective sound.

12 Claims, 7 Drawing Sheets

100
101
102
103
104
111
120
121
122
123
124
125
126
D
131
132
132V
132L
132R
133
133V
133L
133R
134
134V
134L
134R
140
141
142
143
144
145
151
152
153
161
170
171
172
173L
173R
300
BPF
VIDEO DEMODULATION CIRCUIT
LEFT-CHANNEL AUDIO DEMODULATION CIRCUIT
RIGHT-CHANNEL AUDIO DEMODULATION CIRCUIT
SOUND GENERATOR
SYSTEM CONTROLLER
OPERATING CONSOLE
REFERENCE SIGNAL OSCILLATION CIRCUIT
FOCUSING SERVO CIRCUIT
TRACKING SERVO CIRCUIT
LPF
SLIDER SERVO CIRCUIT
SPINDLE SERVO CIRCUIT
M

INFORMATION REPRODUCING APPARATUS AND GAME MACHINE INCLUDING THE SAME

This is a continuation of application Ser. No. 07/920,521 filed Jul. 28, 1992, which is a continuation of application Ser. No. 07/492,502, filed on Mar. 13, 1990.

BACKGROUND OF THE INVENTION

1. Field of the Invention

This invention relates to an information reproducing apparatus such as a videodisk player and a game machine including the same.

2. Description of the Related Art

It often happens that a microcomputer is externally connected to an apparatus for reproducing information in a recording medium such as a videodisk player to constitute a video reproducing system.

In such a video reproducing system, there is often provided a warning sound or caution sound which is produced in order to warn a user of an erroneous operation of the system or to caution the user against a performance of the system. As an example of these sounds, a so called beep sound, which is produced from a buzzer assembly is ordinarily used.

However, since the user operates the videodisk player and the videodisk player is often located apart from the microcomputer, in such a situation the user is not able to hear the beep sound occurring. Further, the beep sound has a narrow frequency band and is a monotonous tone and hence it is difficult to express various kinds of messages.

SUMMARY OF THE INVENTION

It is an object of this invention to provide an apparatus for reproducing information in a recording medium and a game machine including the apparatus which are capable of generating various kinds of sounds or voices having sufficient amount of volume and a wide variety of tones in order to warn a user of an improper operation of the system or to inform the user of an information concerning an operation state of the system.

In carrying out this invention in one preferred mode, there is provided an apparatus for reproducing information in a recording medium comprising: signal reproducing means for reading out an information signal recorded in a recording medium and demodulating a reproduction audio signal from said information signal; control means for controlling said signal reproducing means to provide an operation mode corresponding to an operating command; and sound generating means for generating an indication audio signal, said control means controlling said sound generator in accordance with at least one of an operating command and a reproducing state of said apparatus.

Further, according to this invention, there is provided a game machine, which comprises: an apparatus for reproducing information in a medium, said apparatus comprising signal reproducing means for reading out an information signal recorded in a recording medium and demodulating a reproduction ion audio signal from said information signal, control means for controlling said signal reproducing means to provide an operation mode corresponding to an operating command, and sound generating means for generating an indication audio signal, said control means controlling said sound generator in accordance with at least one of an operating command and a reproducing state of said apparatus; a display device; a sound output device and an external operating device.

DESCRIPTION OF THE PREFERRED EMBODIMENTS

Hereinafter, the first embodiment of the information reproducing apparatus of this invention is described in detail with reference to the drawings.

Figure 1:
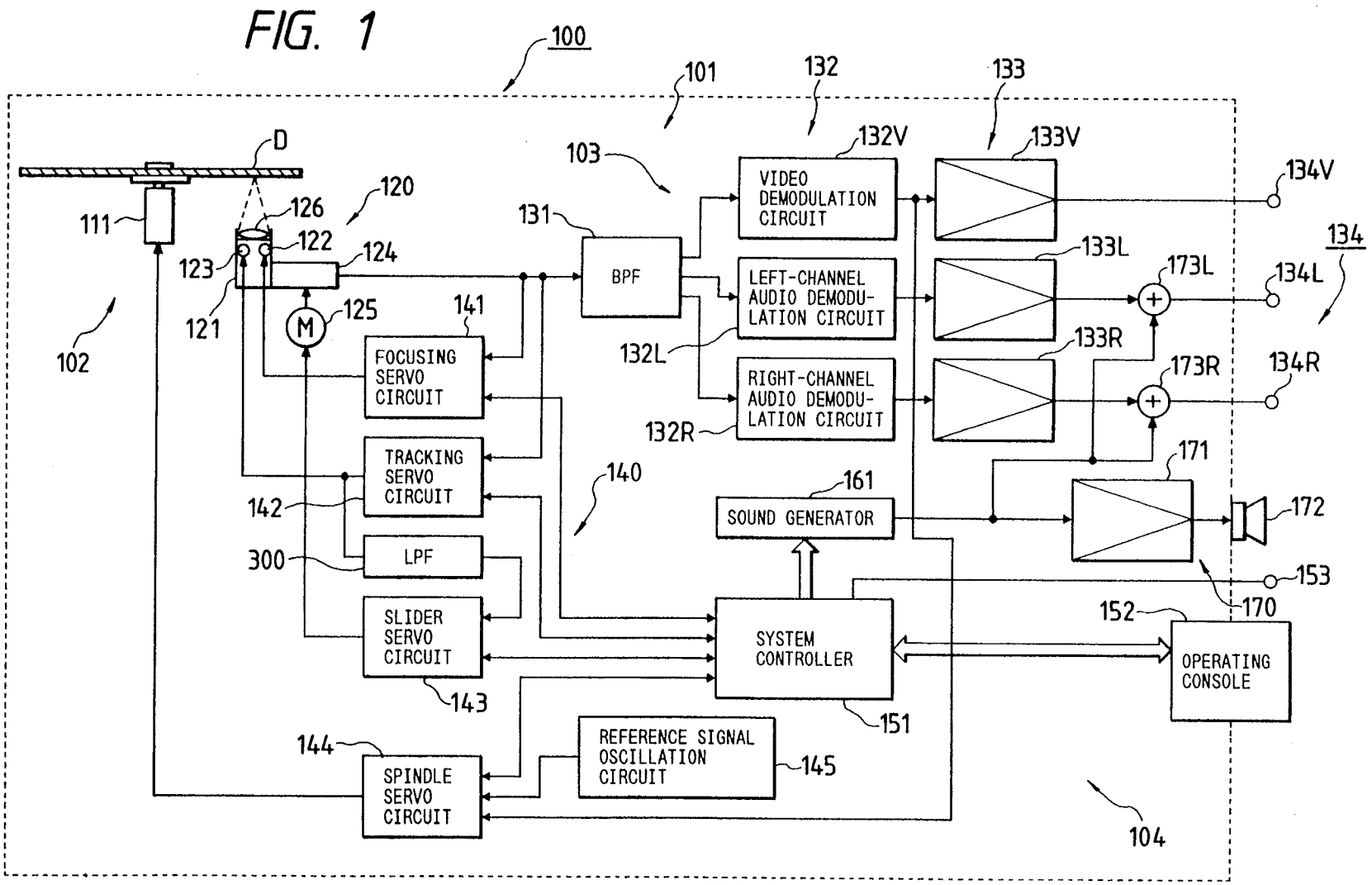
FIG. 1 is a block diagram showing a first embodiment of recording medium reproducing information apparatus of this invention.

FIG. 1 shows an optical videodisk player (hereinafter referred to as player) according to a first embodiment of the recording medium reproducing information apparatus of this invention.

The player 100 is provided with a signal reproducing means 101, a control means 104, a sound generator 161, and a signal processing means 170. The signal reproducing means 101 reads out an information signal recorded in a recording medium and demodulates a reproduction audio signal from the information signal. The control means 104 controls the signal reproducing means 101 so as to obtain an operation mode corresponding to an operating command. The sound generator 161 is controlled by the control means 104 in accordance with the operating command or a reproducing state and produces an indication audio signal. The signal processing means 170 processes the indication audio signal from the sound generator 161 to output sound.

The signal reproducing means 101 has an information reader 102 and a signal demodulator 103.

The information reader 102 includes a spindle motor 111 and an optical head 120. The spindle motor 111 rotates a videodisk (hereinafter referred to as disk) D as the recording medium. The optical head 120 optically reads out an information recorded in a recording track on the disk D and converts it into an electric signal (hereinafter referred to as RF signal, where RF is an abbreviation for Radio Frequency). The RF signal is a modulated signal.

The optical head 120 is provided with an optical pickup 121 which irradiates a light beam on the disk D and detects a reflected light. The slider 124 both supports the optical pickup 121 and slides the optical pickup 121 in the radial direction of the disk D. The slider motor 125 drives the slider 124.

The optical pickup 121 has an objective lens 126, a focusing actuator 122 and a tracking actuator 123. The objective lens 126 concentrates the light beam. The concentrated light beam forms a spot-like light (hereinafter referred to as an information reading light spot) on the disk D. The focusing actuator 122 moves the objective lens 126 in the direction of the disk D to control a location of the focus of the concentrated light beam. The tracking actuator 123 moves the objective lens 126 in the right-angled direction to the direction of the recording track to make the spot trace the recording track with fidelity.

The signal demodulator 103 is provided with a band-pass filter 131, a demodulation block 132, an amplification block 133 and an external output terminal 134. The band-pass filter 131 separates a video RF signal and an audio RF signal of right and left channels from the RF signal. The demodulation block 132 demodulates both the video RF signal and the audio RF signal and detects a video reproduction signal and an audio reproduction signal. The amplification block 133 amplifies the demodulated signals up to an appropriate level to output an amplified signals.

The demodulation block 132 is provided with a video demodulation circuit 132V, a left-channel audio demodulation circuit 132L, and a right-channel audio demodulation circuit 132R. The amplification block 133 is provided with a video signal amplification circuit 133V, a left-channel audio signal amplification circuit 133L and a right-channel audio signal amplification circuit 133R. The external output terminal 134 has a video output terminal 134V, a left-channel audio output terminal 134L and a right-channel audio output terminal 134R.

The control means 104 is provided with a servo block 140, a system controller 151, an operating console 152 as an external operating means and an external microcomputer connecting terminal 153. The servo block 140 servo-controls the optical head 120 or spindle motor 111. The system controller 151 controls each section of the player 100 such as the servo block 140. The operating console is a means for externally operating the player 100. The external microcomputer connecting terminal 153 is a terminal used for connecting an external microcomputer to control the system controller 151.

The servo block 140 includes four circuits which are a focusing servo circuit 141, a tracking servo circuit 142, a slider servo circuit 143 and a spindle servo circuit 144. A reference signal oscillation circuit 145 is connected to the spindle servo circuit 144.

The focusing servo circuit 141 controls the focus of the information reading light spot on the basis of a focus error signal contained in an electric signal which the optical head 120 reads out. For this purpose, the focusing servo circuit 141 is connected to the optical head 120 and the focusing actuator 122. The focusing servo circuit 141 receives a focus error signal from the optical head 120 and supplies a focusing servo control signal to the focusing actuator 122. Further, the focusing servo circuit 141 is connected to the system controller 151 and can be controlled by the system controller 151.

The tracking servo circuit 142 controls a tracking operation of the information reading light spot on the basis of a tracking error signal contained in the electric signal which the optical head 120 reads out. For this purpose, the tracking servo circuit 142 is connected to the optical head 120 and the tracking actuator 123. The tracking servo circuit 142 receives a tracking error signal from the optical head 120 and supplies a tracking servo control signal to the tracking actuator 123. The tracking servo control signal is also supplied to the slider servo circuit 143 described hereinafter. Further, the tracking servo circuit 142 is also connected to the system controller 151 and is controllable by the system controller 151.

The slider servo circuit 143 controls the slider motor 125 which moves the slider 124 in the radial direction of the disk D. For this purpose, the slider servo circuit 143 is connected to the tracking servo circuit 142 and the slider motor 125. The slider servo circuit 143 receives a tracking servo control signal from the tracking servo circuit 142 through a low pass filter 300 and is connected to the system controller 151 and is controlled by the system controller 151.

The spindle servo circuit 144 controls the spindle motor 111 at a predetermined speed. For this purpose, the spindle servo circuit 144 is connected to the reference signal oscillation circuit 145, the signal demodulator 103 and the spindle motor 111. The spindle servo circuit 144 receives a reference signal from the reference signal oscillation circuit 145 and also receives a video signal from the signal demodulator 103 and then compares the reference signal with a synchronizing signal of the video signal. As a result of the comparison, when the synchronizing signal of the video signal is not identical with the reference signal, the speed of the spindle motor 111 deviates from a predetermined speed. In this event, the spindle servo circuit 144 supplies to the spindle motor 111 a spindle servo control signal for returning the spindle motor to the predetermined speed. Further, the spindle servo circuit 144 is also connected to the system controller 151 and controlled by the system controller.

Figure 2:
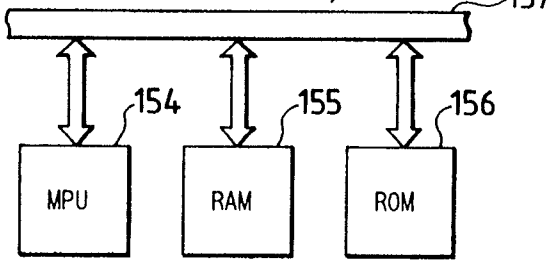
FIG. 2 is a block diagram showing a constitution of a system controller according to an embodiment of this invention.

As shown in FIG. 2, the system controller 151 is provided with a microprocessor 154, a random access memory (hereinafter referred to as RAM) 155, a read only memory (hereinafter referred to as ROM) 156 and a bus 157. The microprocessor 154 carries out a main operational processing of the system controller 151. The RAM 155 is a memory device for provisionally storing an input information or an operational result or the like. The ROM 156 is a memory device for maintaining a predetermined program or the like. The bus 157 is provided to input and output an information and interconnect respective elements of the system controller 151 with each other.

Figure 3:
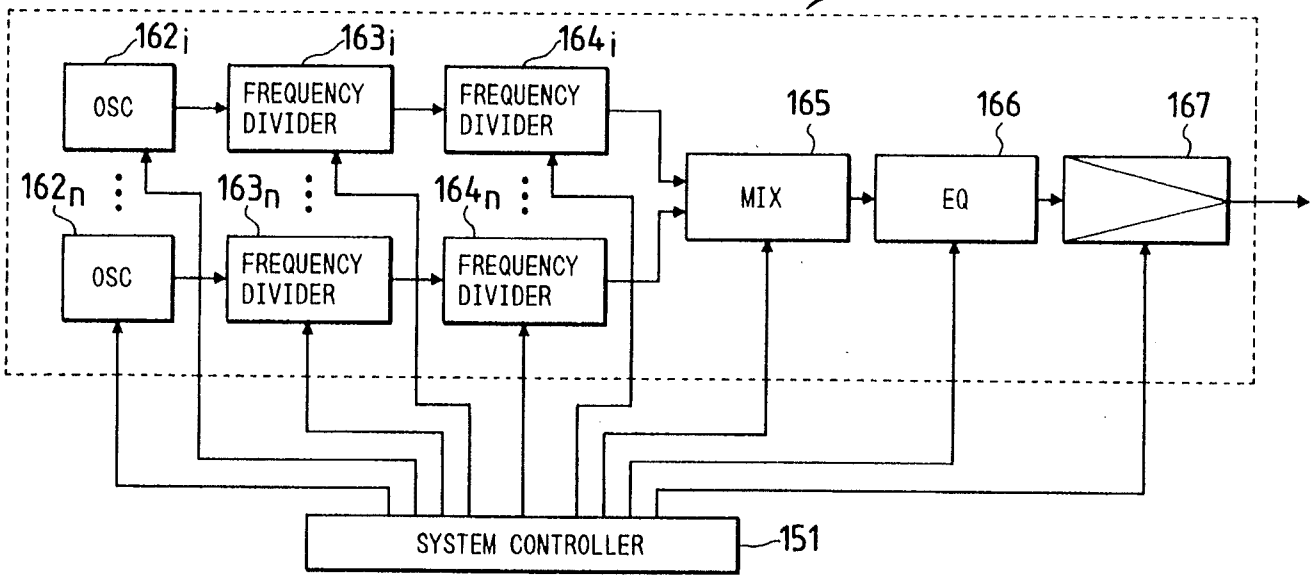
FIG. 3 is a block diagram showing a constitution of a sound generator according to an embodiment of this invention.

As shown in FIG. 3, the sound generator 161 acting as sound generating means is provided with a plurality of oscillators **162*i*–162*n*, a plurality of frequency dividers 163*i*–164*n*, a mixer 165, an equalizer 166 and an amplifier 167. The oscillators 162*i*–162*n* generate a plurality of oscillation signals of different frequencies or waveforms. For example, a signal in the form of sine wave, triangular wave, square wave or the like is generated. The frequency dividers 163*i*–164*n* are connected in series or in parallel with the oscillators 163*i*–164*n* and produce frequency-divided oscillation signals. The mixer 165 is connected to the output of frequency-dividers 163*i*–164*n* and mixes the frequency-divided oscillation signals and produces a mixed oscillation signal. The equalizer 166 is connected to the output of mixer 165 and equalizes a frequency characteristic of the mixed oscillation signal and produces an equalized oscillation signal. The amplifier 167 is connected to the output of the equalizer 166 and amplifies the equalized oscillation signal up to an adequate level and produces an output signal. Further, the system controller 151 is connected to the oscillatiors 162*i*–162*n*, the frequency-dividers 163*i*–164*n*, the mixer 165, the equalizer 166 and the amplifier 167, respectively. The system controller 151 controls the number or kind of the oscillation signals, the value of frequency division ratio of the frequency dividers 163*i*–164*n*, the value of mixing ratio of the mixer 165, the frequency characteristic which is to be equalized and the value of gain of amplifiler 167** or the like.

The signal processing means 170 includes an amplifying circuit 171 and a loud speaker 172. The amplifying circuit 171 is connected between the sound generator 161 and the speaker 172. The amplifying circuit 171 receives the output signal of the sound generator 161 and amplifies it up to an appropriate level and supplies it to the speaker 172. The speaker 172 converts the indication audio signal generated by the sound generator 161 into sound and outputs the sound outwardly from the player 100.

Hereinafter, the operation of player 100 is described.

In the player 100, the spindle motor 111 rotates the disk D. The optical pickup 121 irradiates the information reading light spot on the recording track of the optical disk D and detects the reflected light and then reads out the information recorded on the disk D. The optical pickup 121 is supported by the slider 124 which is moved by the slider motor 125 in the radial direction of the disk D. The optical pickup 121 is provided with the tracking actuator 123, the focusing actuator 122 and the objective lens 126. As a result, the optical pickup 121 freely positions the information reading light spot in the radial direction of the disk D, and freely adjusts the focus of the light spot. From the electric signal read out by the optical pickup 121, a focus error signal necessary for a focus servo control and a tracking error signal necessary for a tracking servo control are extracted, respectively.

The focus error signal is transmitted to the focus servo circuit 141. The focus servo circuit 141 calculates the focus error signal. As a result of the calculation, when it is detected that the focus of the light spot deviates from a surface of the signal pit on the disk D, the focusing servo control signal is supplied to the focusing actuator 122. The focusing actuator 122 receives the focusing servo control signal and adjusts the location of the focus of light spot so as to return the focus of light spot onto the surface of the signal pit on the disk D.

The tracking error signal is supplied to the tracking servo circuit 142. The tracking servo circuit receives the tracking error signal and carries out the calculation. As a result Of the calculation, when it is detected that the information reading light spot deviated from the track line on the disk D, the tracking servo control signal is supplied to the tracking actuator 123. The tracking actuator 123 receives the tracking servo control signal and moves the position of light spot in a transverse direction to the direction of the recording track and adjusts the light spot so as to return the spot onto the track.

During an usual reproduction, the slider servo circuit 143 gives a control signal to the slider motor 125 to move the slider 124 in the radial direction of the disk. However, during a high speed search or a still picture reproduction excluding the usual reproduction, an operation is carried out so that the track is jumped. In this situation, from the system controller 151 to the tracking servo circuit 142, a track jumping pulse signal is supplied for jumping the track to move the tracking actuator 123 with a higher speed than the speed during the usual reproduction. After the time when the light spot reaches a predetermined position, the system controller 151 controls each of the servo circuits so as to return them onto an usual servo operation such as the tracking servo operation, the focus servo operation and the slider servo operation.

The spindle servo circuit 144 supplies the spindle servo control signal to the spindle motor 111 and rotates the spindle motor 111 stably with a predetermined rotational speed. To attain this feature, the spindle servo circuit 144 compares the reference signal generated by the reference signal oscillation circuit 145 having a crystal oscillator with the synchronizing signal of the video reproduction signal from the signal demodulator 103. Consequently, when the rotational speed deviates from the predetermined speed, the spindle servo circuit 144 supplies the spindle servo control signal to the spindle motor 111 and controls it so that the motor may be returned to the predetermined rotational speed.

The system controller 151 decodes a code corresponding to an operation on the basis of an input from the operating console 152 or data or a program stored in the RAM 155 or the ROM 156 and transmits it to the microprocessor 154. The microprocessor 154 carries out operational processings and permits control of respective servo circuits 141–144 or the sound generator 161 of the information reproducing apparatus. The system controller 151 is provided with an external microcomputer connecting terminal 153 so as to constitute a video reproduction system.

The RF signal which is an electric signal read out by the optical pickup 121 is supplied to the band-pass filter 131. The band-pass filter 131 separates the RF signal into a video FM carrier wave which is the signal with a frequency band within 3.5 MHz–15 MHz, a left-channel audio FM carrier wave with a center frequency of 2.3 MHz and a diviation band width of ±100 KHz and a right-channel audio FM carrier wave with a center frequency of 2.8 MHz and a deviation band width of ±100 KHz. The video FM carrier wave is supplied to the video demodulation circuit 132V and demodulated to form a video reproduction signal and amplified through the amplifier circuit 133V and then output from the output terminal 134 V. As to an audio information, the right and left-channel audio FM carrier waves separated by the band-pass filter 131 are respectively supplied to the right and left-channel audio demodulation circuits 132R and 132L. The right and left-channel audio FM carrier waves are respectively demodulated to form a right and a left-channel audio reproduction signal and respectively amplified through the amplifiers 133R and 133L and output from the right and left-channel terminals 134R and 134L. The indication audio signal generated by the sound generator 161 which is an oscillating signal is amplified by the amplifier circuit 171 up to a proper level and converted into sound and output externally through the speaker 172.

Figure 4:
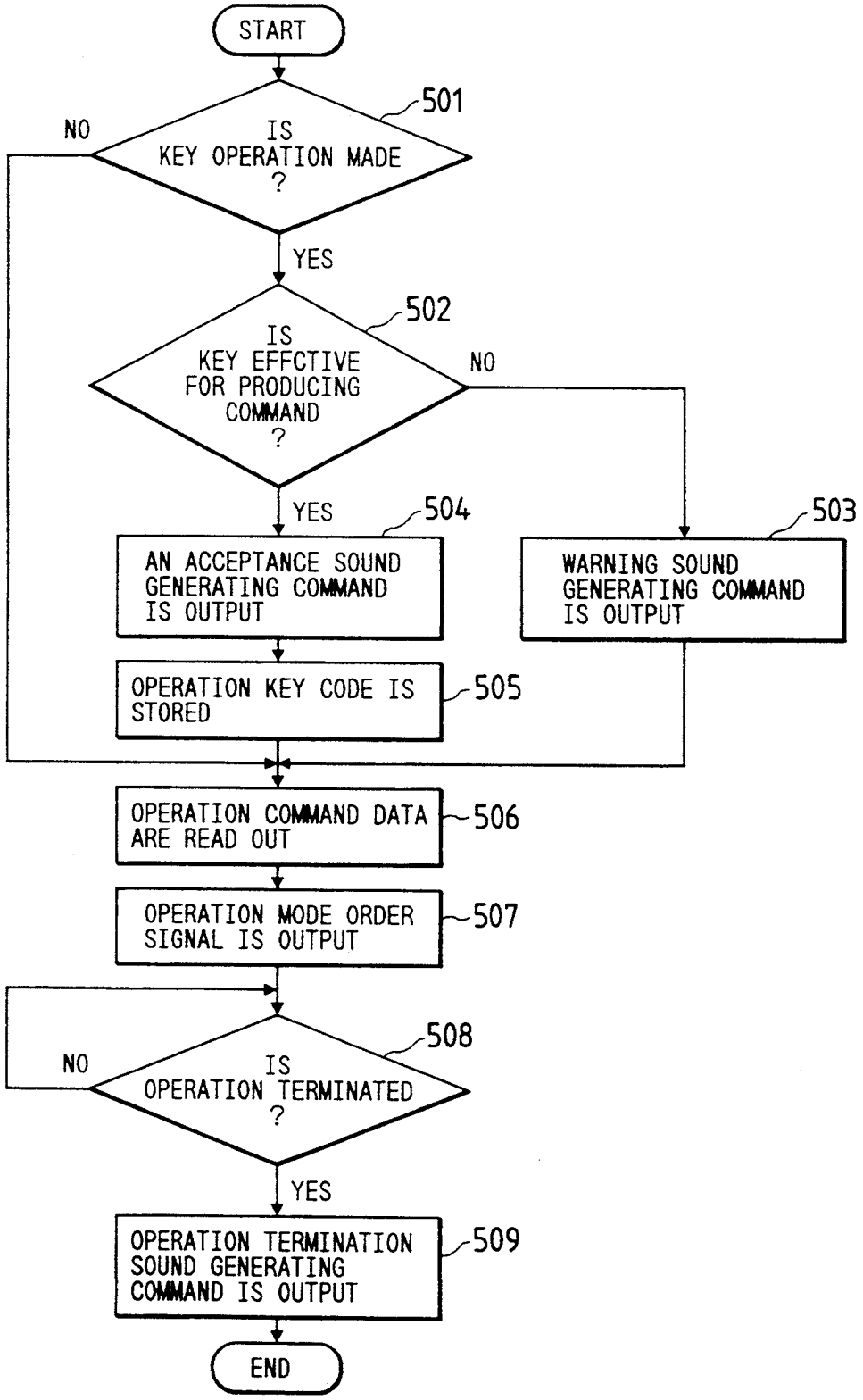
FIG. 4 is a flowchart showing a program for controlling a microprocessor shown in FIG. 2.

In the videodisk player 100, a processing flowchart of the microprocessor 154 when an operation is effected through the operating console 152 or the external microcomputer connecting terminal 153, is shown in FIG. 4 and an action is described.

The microprocessor 154 always monitors the operating console with an interruption processing method and decides whether the operation input is made or not (step 501). When it is decided that the operation input is made the microprocessor 154 decides whether an operated key is one useful for producing an effective command during a present operation mode (step 502). As a result, when the operated key is not an effective key operation, a warning sound generating command for generating a warning sound (for example, a bass sound continuing over 2–3 seconds) used for warning the user that the key operation is not an effective key operation is applied to the sound generator 161 (step 503). On the other hand, when the key operation is effective, the microprocessor 154 applies to the sound generator 161 an acceptance sound generating command for generating an acceptance sound (for example, a treble sound continuing over 0.1–0.2 seconds) used for advising the user that the key operation is effective (step 504).

Further, the microprocessor 154 reads out from the ROM 156 an operation command data corresponding to the operation key code stored in the RAM 155 (step 506). In accordance with the operation command data, the microprocessor 154 produces operation mode order signals including a performance order signal and a search position order signal, so as to supply these signals to the focusing servo circuit 141, tracking servo circuit 142, slider servo circuit 143 and spindle servo circuit 144. (step 507).

When the operation is terminated, the microprocessor 154 monitors the number of crossing tracks supplied from the track crossing detection signal or the video output signal and then decides whether the operation is terminated or not (step 508). Further, when the operation is finished, the microprocessor 154 applies to the sound generator 161 an operation termination sound generating command for generating an operation termination sound (for example, a middle sound continuing over 2–3 seconds) used for advising the user that the operation is terminated (step 509).

The sound generator 161 generates a sound signal in accordance with the kinds of oscillation signal waves, a frequency division ratio value, a mixing ratio value of a mixer, a frequency characteristic of an equalizer and a gain value of an amplifier, which are respectively designated by the warning sound generating command, acceptance sound generating command or operation termination sound generating command.

First, the oscillators **162*i*–162*n* oscillate an oscillation signal of a wave such as a sine wave, a triangular wave, or a square wave. The frequency dividers 163*i*–164*n*** divide the oscillation signal into a plurality of divided frequencies.

Second, the mixer 165 mixes these signals with a mixing ratio designated by the system controller 161. Further, the mixed signal is converted into a signal having a frequency characteristic of the kind which is designated by the system controller 161. Finally, the amplifier 167 amplifies the equalized signal up to a signal level designated by the system controller 161 and produces it as an output signal. The output signal is put out outwardly as sound through the amplifier 171 and the speaker 172.

As described above, since the warning sound or the indication sound are omitted from the speaker 172 of the player 100, an operating user can be informed of an erroneous key operation or a terminated operation near the player and during real time. The volume or tone of indication sound are desirably variable by the sound generator 161 and hence there is the advantage that the warning or caution can be clearly indicated. In addition, the signal processing means 170, as shown in FIG. 1 may be provided with the adder 173L and 173R which are both signal adding means. The adder 173L is provided between the left-channel audio signal amplification circuit 133L and the left-channel audio output terminal 134L, and is connected to the sound generator 161. The adder 173R is provided between the right-channel audio signal amplification circuit 133R and the right-channel audio output terminal 134R, and is connected to the sound generator 161. With such construction, the indication audio signal produced from the sound generator 161 is supplied to the adders 173L and 173R. Accordingly, when an audio amplifier and a loud speaker are connected to the audio output terminals 134L and 134R, the warning sound, acceptance sound and operation termination sound as described above are mixed with the reproduction sound of the disk so as to be output. As a result, in this case an operating user can also be advised of the erroneous key operation or the termination operation during real time.

Figure 5:
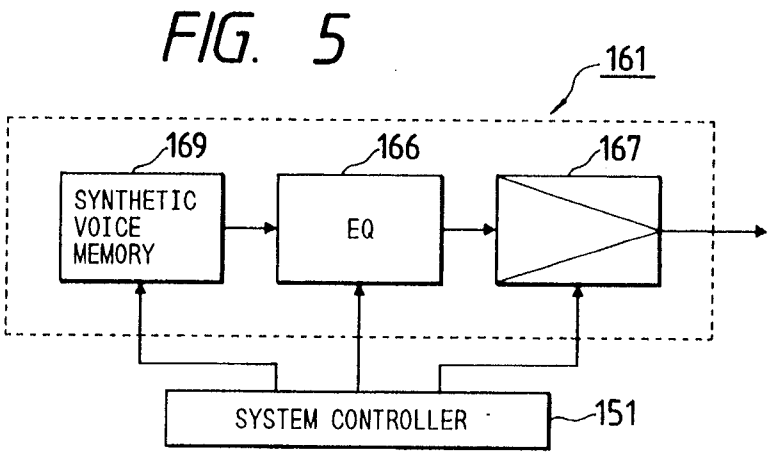
FIG. 5 is a block diagram showing a second embodiment of the recording medium reproducing information apparatus of this invention.

Further, it may be possible that the sound generator 161 generates a synthetic voice. That is, it may be possible that as shown in FIG. 5, a plurality of synthetic voice information stored in a synthetic voice memory 169 including a ROM or a magnetic memory device are read out as a synthetic voice signal and a frequency characteristic of the synthetic voice signal is modified by the equalizer 166 and then the modified signal is amplified by the amplifier 167 up to an adequate value and are output.

Figure 6:
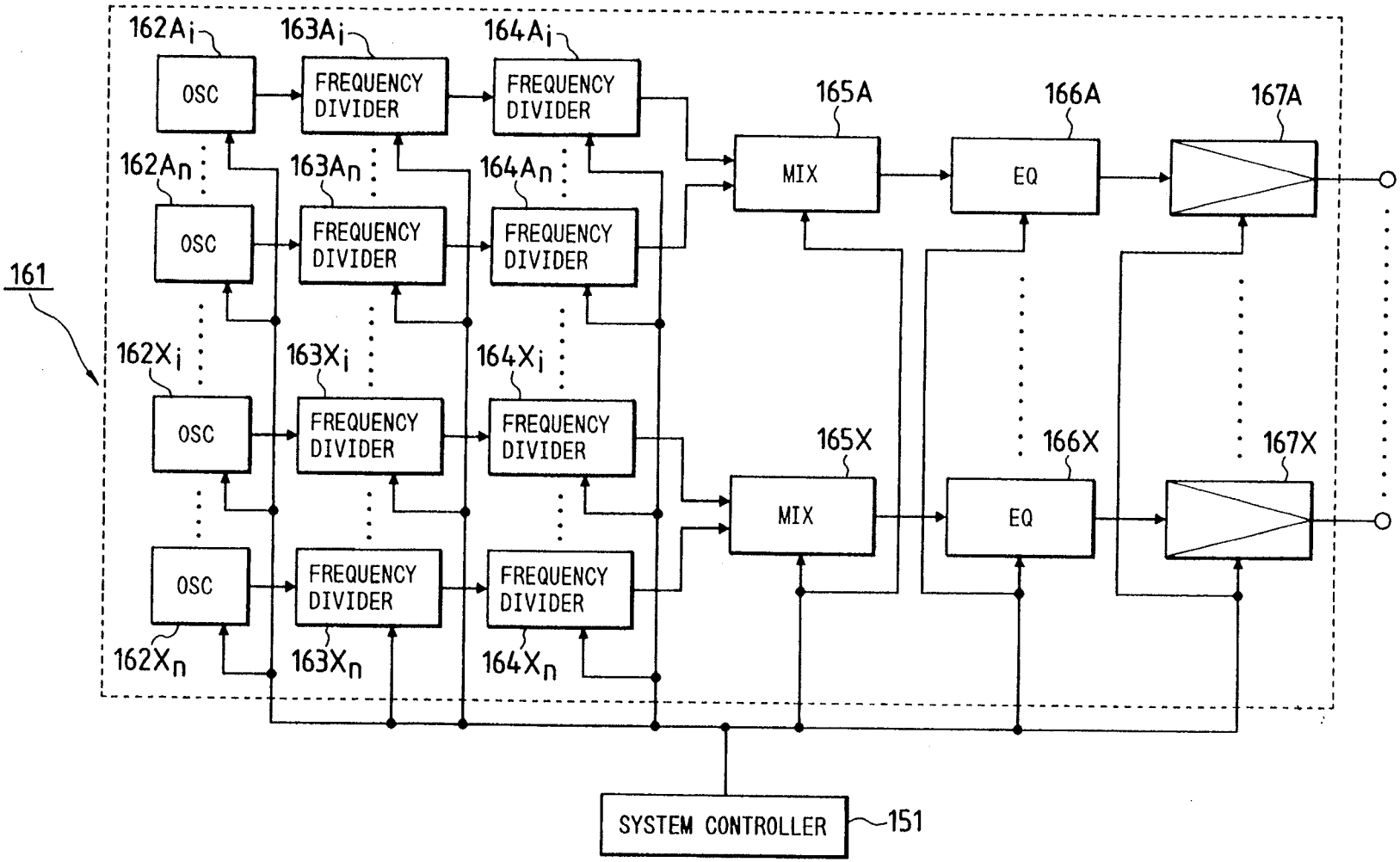
FIG. 6 is a block diagram showing a constitution of a sound generator shown in FIG. 5.
Figure 7:
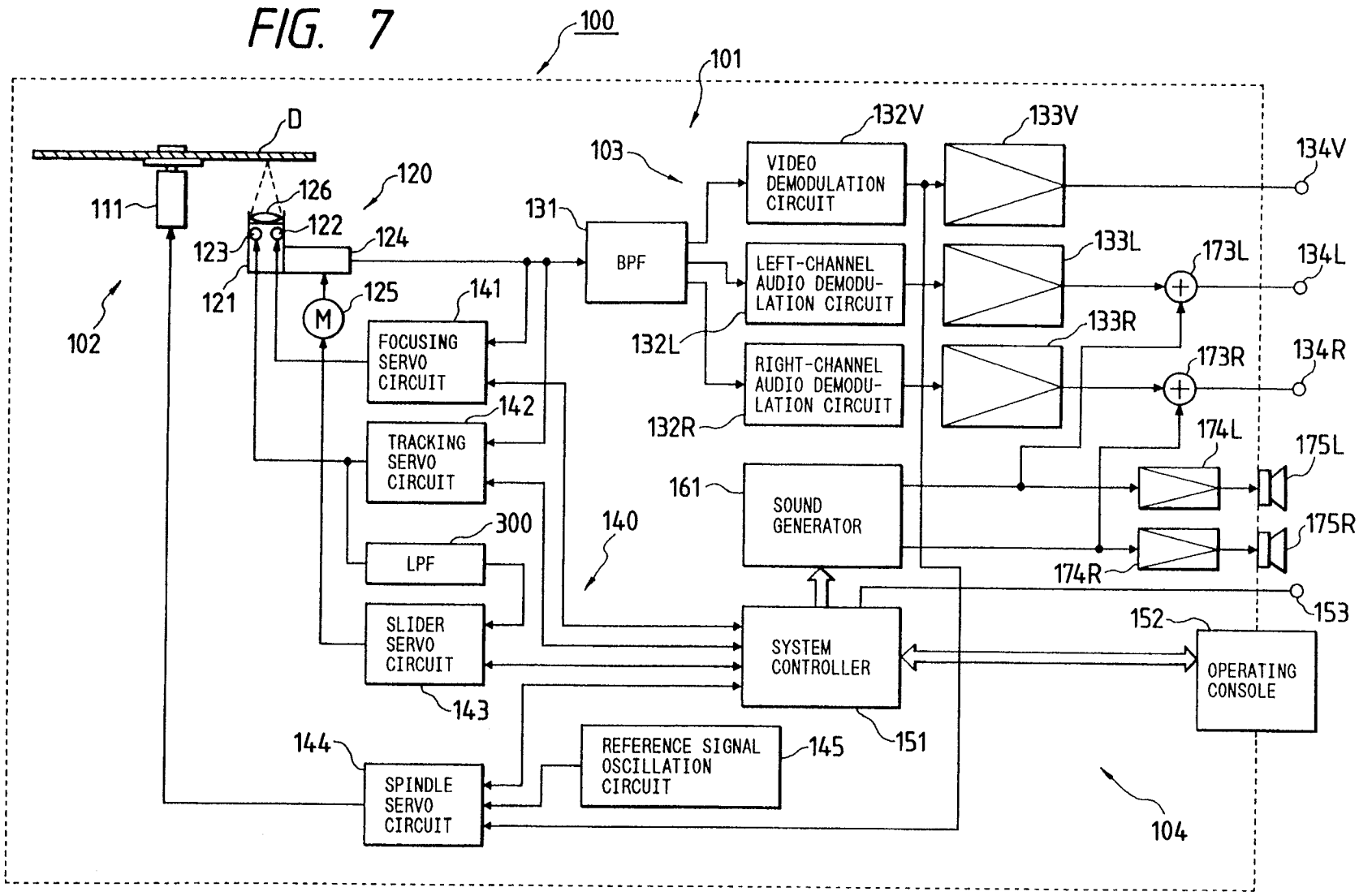
FIGS. 7 and 8 are block diagrams each showing another embodiment of the sound generator according to an embodiment of this invention.

Further, it may be possible that the sound generator 161 generates an audio signal, having a plurality of channels, as shown in FIG. 6 as a second embodiment. In the case of two channels, as shown in FIG. 7, it may be possible that the right channel sound and the left channel sound are produced different from each other.

Figure 8:
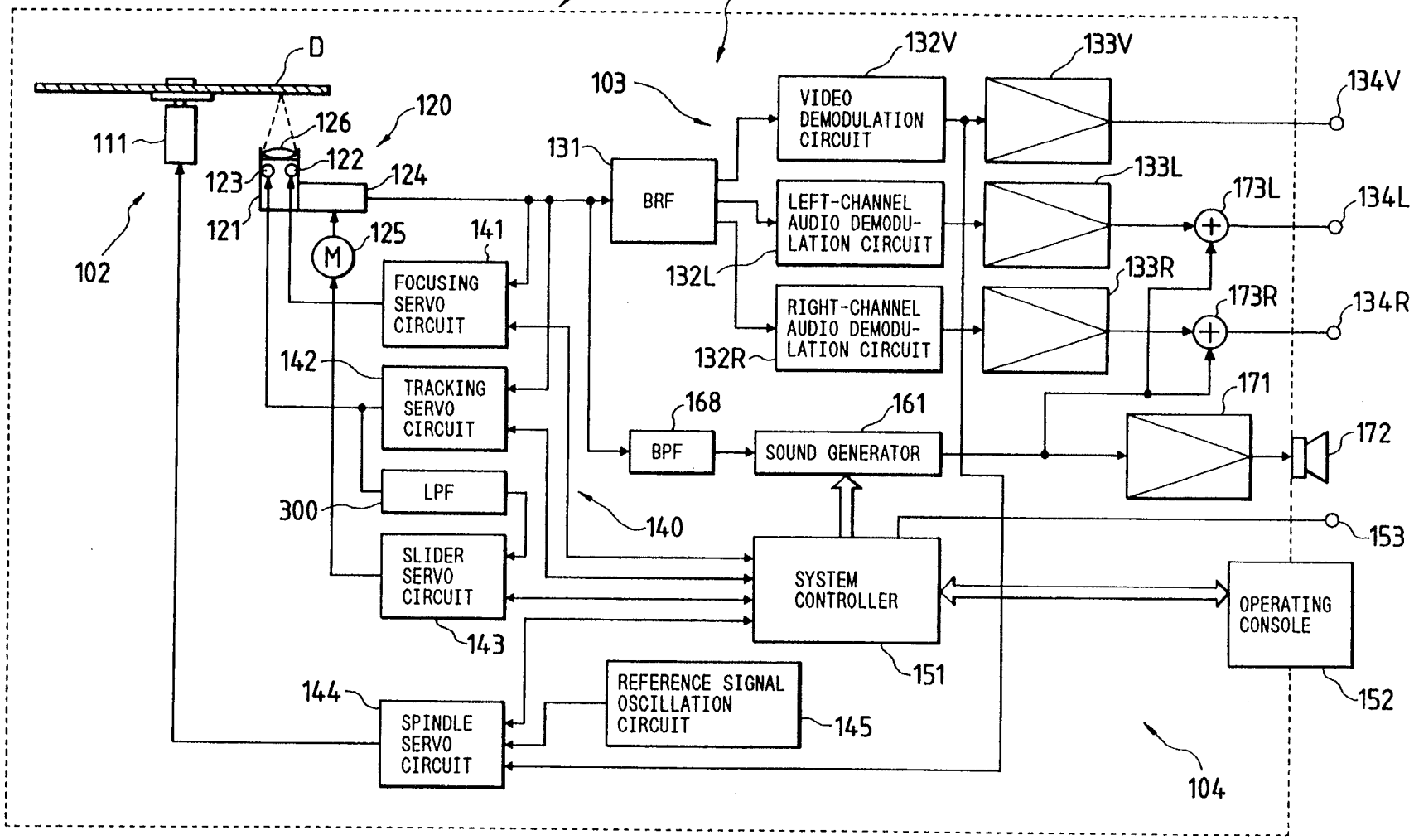
Figure 9:
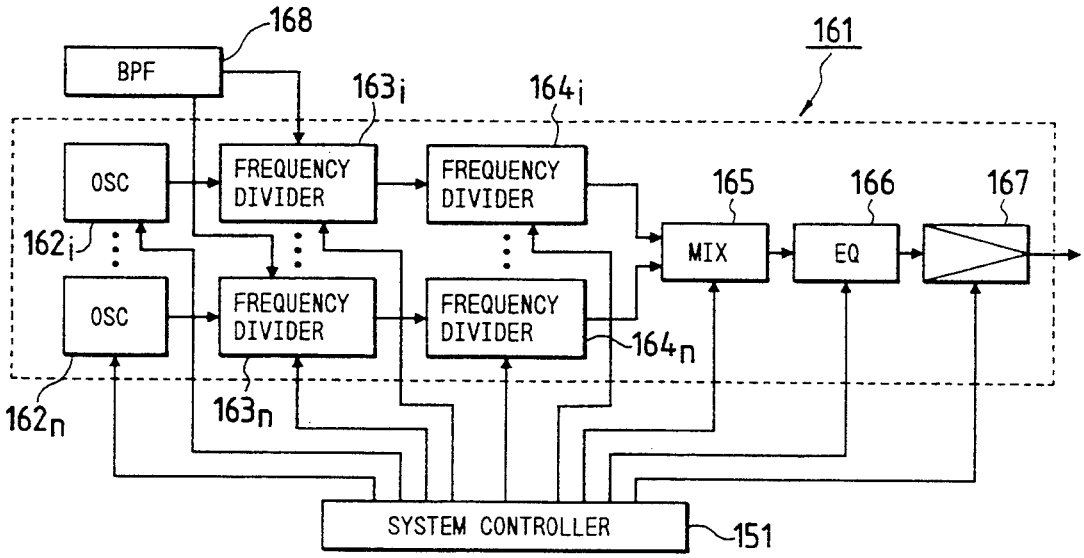
FIG. 9 is a block diagram showing a third embodiment of the recording medium reproducing information apparatus to which an embodiment of the sound generator of FIG. 8 is applied.

Still further, in the first embodiment as described above, in order to inform the erroneously operating user of an information including warning or the like, the oscillation signal of the sound generator 161 is utilized. However, a third embodiment as shown in FIGS. 8 and 9 may be utilized. That is, the RF signal detected by the optical pickup 121 is applied to a band-pass filter 168, and a necessary frequency band is separated and output. The output signal may be frequency-divided by the frequency dividers **163*i*–164*n* and mixed by the mixer 165, and then modified into a given frequency characteristic by the equalizer 166, and then amplified by the amplifier 167 and supplied to the adders 173L and 173R or the amplifier 171**.

Figure 10:
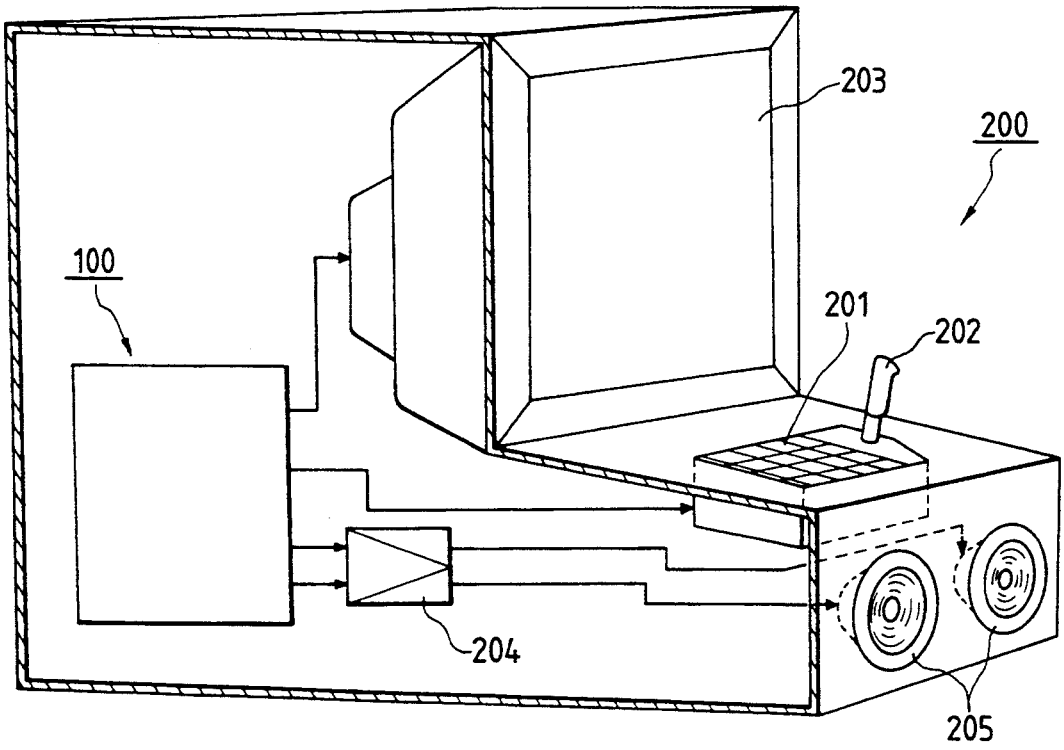
FIG. 10 is a schematic diagram showing an embodiment of a game machine to which one embodiment of this invention is applied.

As shown in FIG. 10, this invention can be applied to a game machine, which is provided with an external operating device such as a key board 201 or a joy stick 202, a display device such as a TV display 203, and a sound output device such as an amplifier 204 and a speaker 205. In this case, it may be possible that the indication audio signal is positively utilized as an effective sound.

As mentioned above, a videodisk player is described as the recording medium reproducing information in apparatus. However, this invention can be also applied to a digital audio disk player, a conventional tape deck, a DAT or the like.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. An apparatus for reproducing information in a recording medium comprising:

signal reproducing means for reading out an information signal recorded in a recording medium and demodulating a reproduction audio signal from said information signal;

control means for controlling said signal reproducing means to provide an operation mode corresponding to an operating command, and for generating an output control signal indicating one of an improper operating command and an operating state of said apparatus;

sound generating means for generating an indication audio signal, which is independent from said information and reproduction signals, in response to said output signal from said control means;

amplifying means for amplifying said indication audio signal; and a loudspeaker electrically coupled to said amplifying means for generating an audible sound in response to amplification of said indication audio signal.

2. An apparatus for reproducing information in a recording medium as claimed in claim 1, wherein said signal reproducing means further comprises signal adding means for mixing said reproduction audio signal from said signal reproducing means with said indication audio signal from said sound generating means.

3. An apparatus for reproducing information in a recording medium as claimed in claim 1, wherein said control means controls a condition concerning a generating timing, a frequency, and a tone of said indication audio signal of said sound generating means.

4. An apparatus for reproducing information in a recording medium as claimed in claim 1, wherein said sound generating means extracts an optional frequency component from said information signal and generates said indication audio signal on the basis of said optional frequency component.

5. An apparatus for reproducing information in a recording medium as claimed in claim 1, wherein said sound generating means includes:

a plurality of oscillators for generating a plurality of oscillation signals having a plurality of different waveforms;

a plurality of frequency dividers for dividing said oscillation signals;

a mixer for mixing said oscillation signals with each other to output a mixed oscillation signal;

an equalizer for equalizing a frequency characteristic of said mixed oscillation signal to output an equalized oscillation signal; and an amplifier for amplifying a level of said equalized oscillation signal.

6. An apparatus for reproducing information in a recording medium as claimed in claim 1, wherein said sound generating means generates a plurality of said different indication audio signals having a plurality of channels.

7. An apparatus for reproducing information in a recording medium as claimed in claim 1, wherein said sound generating means includes:

a plurality of oscillators for generating a plurality of oscillation signals having a plurality of different wave forms;

a plurality of frequency dividers for dividing said oscillation signals;

a plurality of mixers for mixing said oscillation signals with each other to output a plurality of mixed oscillation signals;

a plurality of equalizers for equalizing a frequency characteristic of said mixed oscillation signals to output a plurality of equalized oscillation signals; and a plurality of amplifiers for amplifying a level of said equalized oscillation signals.

8. An apparatus for reproducing information in a recording medium as claimed in claim 1, wherein said control means includes a microprocessor, a memory and a bus, said control means controlling a generating condition concerning a plurality of oscillation signal waveforms, a frequency division ratio, a mixing ratio, a frequency characteristic, a signal level gain of an amplifier, and a signal generating timing of said sound generating means in accordance with data, a program stored in said memory, and said operating command based on an input from external operating means.

9. An apparatus for reproducing information in a recording medium as claimed in claim 1, wherein said control means monitors said operating command, and outputs a warning sound generating command for generating an acceptance sound to said sound generating means when it is decided that said input is improper for producing said operating command during an operation mode monitored, and outputs a caution sound generating command for generating an caution sound when it is decided that said signal reproducing means has terminated a reproducing operation.

10. An apparatus for reproducing information in a recording medium as claimed in claim 1, wherein said control means outputs a synthetic voice generating command for generating a synthetic voice to said sound generating means when it is decided that said input is improper for producing said operating command during an operation mode monitored, and outputs a caution sound generating command for generating a caution sound when it is decided that said signal reproducing means has terminated a reproducing operation.

11. An apparatus for reproducing information in a recording medium as claimed in claim 1, wherein said sound generating means includes:

a synthetic voice memory for storing a synthetic voice information to output a synthetic voice signal;

an equalizer for equalizing a frequency characteristic of said synthetic voice signal to output a equalized synthetic voice signal; and an amplifier for amplifying a level of said equalized synthetic voice signal.

12. A game machine, comprising:

an apparatus for reproducing information in a medium, said apparatus comprising:

signal reproducing means for reading out an information signal recorded in a recording medium and demodulating a reproduction audio signal from said information signal, control means for controlling said signal reproducing means to provide an operation mode corresponding to an operating command and for generating an output control signal indicating one of an improper operating command and an operating state of said apparatus, and sound generating means for generating an indication audio signal, which is independent from said information and reproduction signals, in response to said output control signal;

a display device electrically coupled to said sound generating means;

a sound output device for outputting an audible sound in response to said indication audio signal; and an external operating device.

* * * * *